United States Patent [19]

Fender

[11] 4,031,799

[45] June 28, 1977

[54] BRIDGE FOR STRINGED INSTRUMENTS

[76] Inventor: C. Leo Fender, 2851 Rolling Hills Drive Sp. 33, Fullerton, Calif. 92635

[22] Filed: Jan. 26, 1976

[21] Appl. No.: 652,408

[52] U.S. Cl. ..... 84/307; 84/298; 84/299

[51] Int. Cl.[2] ..... G10D 3/04; G10D 3/00

[58] Field of Search ..... 84/307, 298, 291, 299

[56] References Cited

UNITED STATES PATENTS

| | | | |
|---|---|---|---|
| 2,972,923 | 2/1961 | Fender | 84/307 |
| 3,174,380 | 3/1965 | Cookerly et al. | 84/307 |
| 3,178,985 | 4/1965 | Jeranson | 84/307 |
| 3,290,980 | 12/1966 | Fender | 84/307 |
| 3,538,233 | 11/1970 | Compton et al. | 84/307 |
| 3,599,524 | 8/1971 | Jones | 84/298 |

*Primary Examiner*—Stephen J. Tomsky
*Attorney, Agent, or Firm*—Philip M. Hinderstein

[57] ABSTRACT

In a bridge for stringed instruments of the type including a plurality of independently movable drums which permit independent adjustment of the length and height of each string of the instrument, there is disclosed an improved construction wherein all of the drums are urged axially into contact with each other and a fixed post to reduce vibration of the drums and wherein the adjustment holes through the drums are arranged to prevent fraying of the sleeve of a player of the instrument as such sleeve passes over the bridge.

6 Claims, 6 Drawing Figures

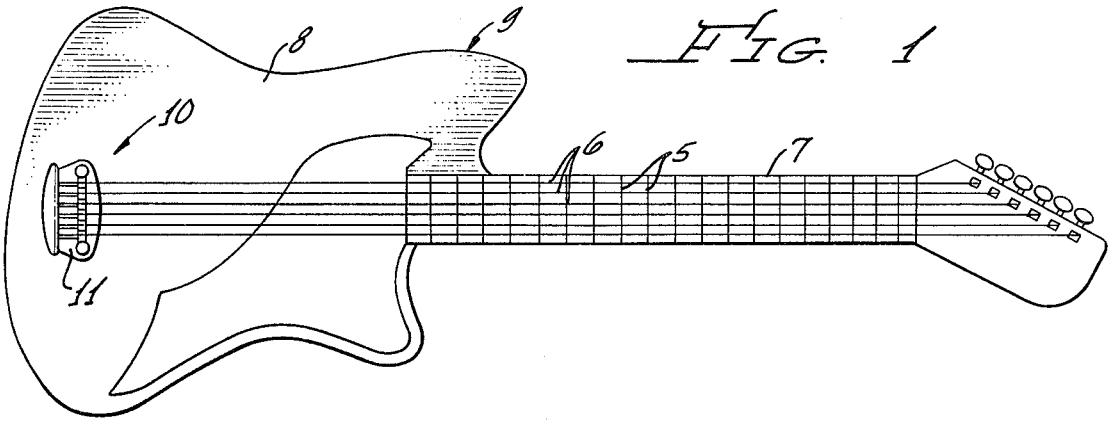
FIG. 1
FIG. 2.
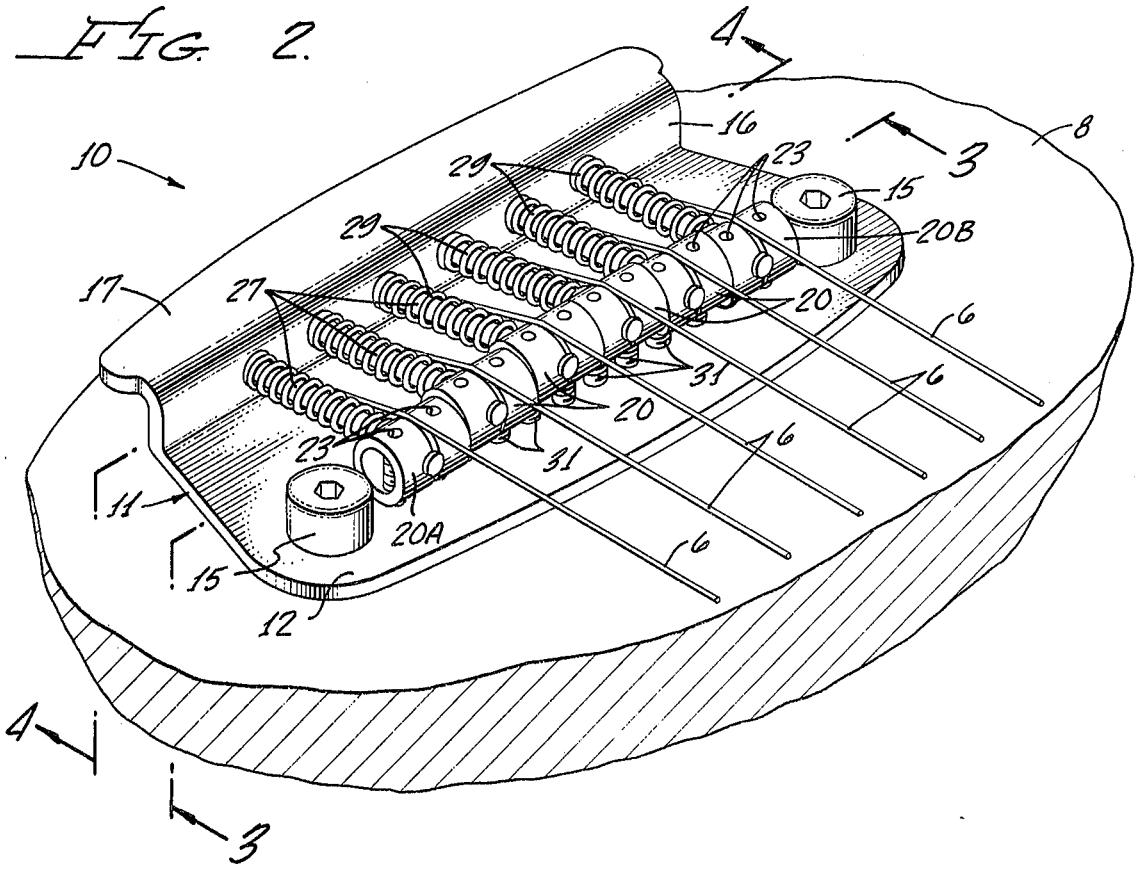

FIG. 3.
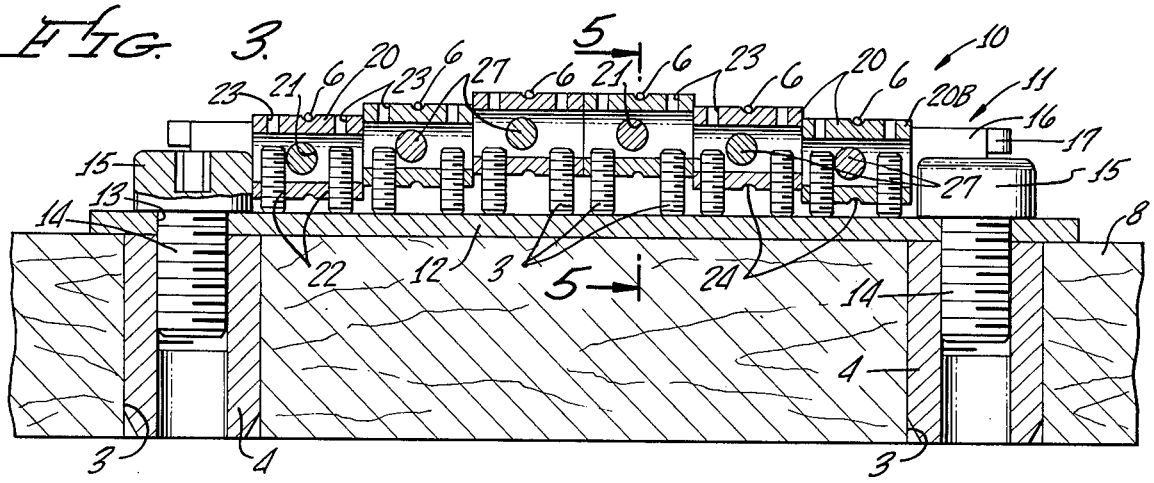
FIG. 4.
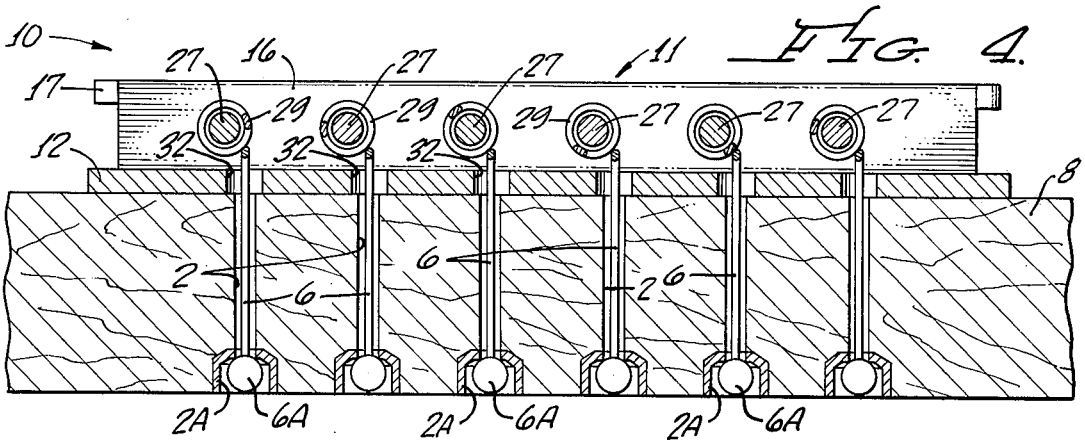
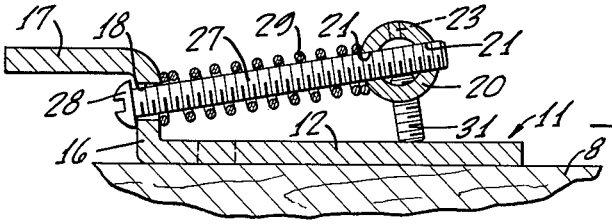
FIG. 5.
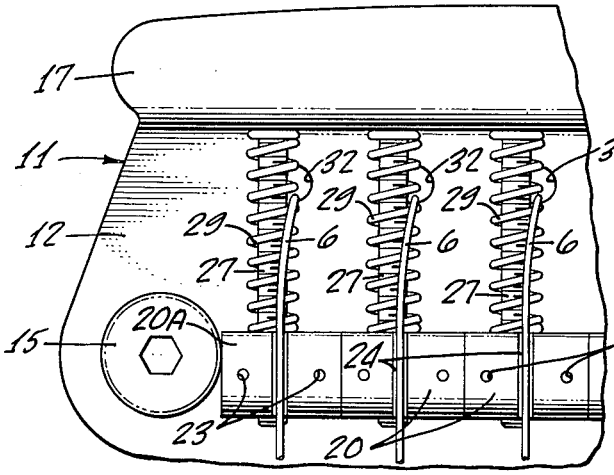
FIG. 6.

BRIDGE FOR STRINGED INSTRUMENTS

BACKGROUND OF THE INVENTION

1. Field of the Invention

The present invention relates to a bridge for stringed instruments and, more particularly, to a stringed instrument bridge which increases the tone sustaining capabilities of the strings and eliminates certain undesirable characteristics of bridges used heretofore.

2. Description of the Prior Art

The function of the bridge of a stringed instrument is to establish fixed connection points for first ends of the strings of such instrument. In many instruments, the spacing between the bridge and the body of the instrument is adjustable to permit adjustment of the height of each string relative to the neck of the instrument. This adjustment makes the instrument adaptable to different users since the spacing between the strings and the neck is a matter of personal choice and substantial variations exist.

Since the connection points of the other ends of the strings are fixed at the end of the instrument neck, adjustment of the spacing between the bridge and the instrument body usually results in a change in the length of each string. In the case of a solid body, fretted instrument, such as an electric guitar or bass, this change in the length of the strings creates a noticable change in the location of the octave point of each string. However, since the octave points must be exactly aligned with one of the frets of the instrument in order to insure proper operation of the strings, it is necessary to simultaneously adjust the lateral position of the bridge when adjustments are made to the height thereof.

For the above reasons, many bridges available today include a plurality of bridge sections constructed as drums positioned in end-to-end relationship, each string of the instrument being conducted over one of the drums, the drums being connected to the bridge plate or base member in a manner which permits their lateral movement in two orthogonal directions so as to separately adjust the length of each string and the height of each string relative to the neck of the instrument. Such a bridge permits the greatest latitude of adjustment possible for each string.

While bridges of the above type provide the degree of adjustablity required, they create certain unwanted problems. That is, the drums are typically connected to the bridge base in a manner which permits a limited amount of axial movement of each drum. As a result, the vibrations of the strings which are conducted over such drums cause the drums themselves to vibrate. Since the tone sustaining capability of a string is a direct function of the rigidity of its end point connections, the ability of the drums to vibrate, which drums define one end point connection, substantially reduces the tone sustaining capability of the strings below the level which is theoretically attainable.

Still another problem created by existing bridges stems from the fact that each drum typically has a pair of internally threaded holes extending laterally therethrough, each of the holes receiving a set screw, all of the set screws extending outwardly from the drums and into contact with the bridge base, the set screws permitting adjustment of the spacing between the drums and the base so as to adjust the height of each string. A wrench is extendable through each hole to engage the head of the set screw to rotate same relative to the drums. These relatively large, threaded holes facing outwardly from the instrument present two problems. First of all, the set screws can be retracted far enough to extend outwardly from the drums and can be removed therefrom and lost. Even if the set screws do not become disconnected from the drums and lost, they rub across the sleeve of the player of the instrument and damage and often ruin such sleeve. Furthermore, even if the head of the set screws are within the drums; the threaded hole itself provides a rough edge which rubs across the sleeve of the musician, damaging such sleeve.

SUMMARY OF THE INVENTION

According to the present invention, these problems are solved by providing a novel bridge for stringed instruments. The present bridge includes a plurality of independently movable drums which permit separate adjustment of the length of each string and the height of each string relative to the neck of the instrument thereby permitting the greatest latitude of adjustment possible for each string. However, the present bridge substantially reduces the ability of the drums to vibrate, substantially increasing the tone sustaining capabilities of each string over that obtainable heretofore. Furthermore, the drums are constructed and connected to the base of the bridge in a manner which prevents loss of the set screws which are used to adjust the height of each string and which prevents damage to the sleeve of player of an instrument using the present bridge.

Briefly, the present bridge for a stringed instrument including a body and a neck comprises: a base member having a first planar section connectable to the body of the instrument and a second planar section connected to one end of the first section and extending perpendicular thereto; a plurality of drums, the strings of the instrument engaging the drums, each of the drums having a first internally threaded hole extending laterally therethrough, a pair of second internally threaded holes extending partially, laterally therethrough, perpendicular to the first holes, and a pair of third unthreaded holes extending partially, laterally therethrough, coaxial with the second holes, the third holes having a smaller diameter than the second holes; a plurality of bolts extending through the second section of the base member and through the first holes in the drum whereby rotation of the bolts relative to the drums moves the drums toward or away from the second section of the base member to separately adjust the length of each string; a plurality of set screws positioned in the second holes in the drums, all of the set screws extending outwardly from the drums and into contact with the first section of the base member to permit independent adjustment of the height of each drum relative to the base member, the third holes being adapted to receive a wrench for contacting the set screws in the second holes to rotate same relative to the drums; a fixed post connected to the base member, adjacent one end of the first one of the drums; and a plurality of holes in the first section of the base member, one for each of the drums, each of the holes extending at least partially beneath its associated bolt, the strings of the instrument extending through the holes in the base member, around one side of the bolts, and then over the drums to apply an axial force to each of the bolts and drums in the direction of the post to urge all of the drums axially into contact with each other and the first drum into contact with the post.

OBJECTS

It is therefore an object of the present invention to provide a bridge for stringed instruments.

It is a further object of the present invention to provide a stringed instrument bridge which increases the tone sustaining capabilities of the strings.

It is a still further object of the present invention to provide a bridge for stringed instruments including a plurality of independently movable drums wherein the ability for the drums to vibrate is substantially reduced.

It is another object of the present invention to provide a bridge for stringed instruments which prevents loss of the multiple parts thereof.

It is still another object of the present invention to provide a bridge for stringed instruments which eliminates damage to the sleeve of the player of the instrument.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like parts in the several figures and wherein:

BRIEF DESCRIPTION OF THE DRAWINGS

FIG. 1 is an elevation view of a conventional stringed instrument, a solid body electric guitar, showing the use of a bridge constructed in accordance with the teachings of the present invention;

FIG. 2 is an enlarged perspective view of the bridge of FIG. 1;

FIGS. 3 and 4 are sectional views taken along the lines 3—3 and 4—4, respectively, in FIG. 2;

FIG. 5 is a sectional view taken along the line 5—5 in FIG. 3; and

FIG. 6 is a partial elevation view of the bridge of FIGS. 1 and 2.

DESCRIPTION OF THE PREFERRED EMBODIMENT

Referring now to the drawings, there is shown a bridge, generally designated 10, which is designed primarily for use with a stringed instrument 9 including a solid body 8, a neck 7, and a plurality of strings 6. Neck 7 would also include a plurality of frets 5, the pitch of each string 6 being changeable by pressing string 6 against one of frets 5.

As is known in such instruments, it is desirable to be able to adjust the height of each string 6 relative to neck 7 to satisfy the personal desires of individual musicians. It is also known that adjustment of the height of a string 6 changes the length and the location of the octave point thereof. Since the octave point must be exactly aligned with one of frets 5, it is necessary to simultaneously adjust the lateral position of bridge 10 when adjustments are made to the height of strings 6. Bridge 10 permits this separate adjustment of the length and height of each string 6 of instrument 9.

Bridge 10 includes a base member 11 having a first planar section 12 connectable to body 8 of instrument 9. Connection of planar section 12 of base member 11 to body 8 may be achieved by providing a pair of aligned holes 3 and 13 in body 8 and section 12, respectively, and securing an internally threaded sleeve 4 in each hole 3. A bolt 14 extends through each hole 13 in section 12 of base member 11 and into sleeve 4, tightening of bolts 14 bringing the heads 15 thereof into contact with the upper surface of section 12 and firmly securing base member 11 to body 8 of instrument 9. One of heads 15 of one of bolts 14 serves an additional function, as will be described more fully hereinafter.

Base member 11 of bridge 10 also includes a second planar section 16, one end of which is made integral with one end of planar section 12 and extends perpendicular thereto and also to body 8 of instrument 9 and a third planar section 17 made integral with the other end of section 16 and extending perpendicular thereto in a direction opposite to the direction of planar section 12. Section 16 of base member 11 has a plurality of spaced holes 18 therein, which are spaced along a line perpendicular to strings 6 of instrument 9, there being one hole 18 for each of strings 6.

Bridge 10 also includes a plurality of identical drums 20, one drum for each string 6, drums 20 being positioned in end-to-end relationship for independent lateral movement in two orthogonal directions to separately adjust the length of each string 6 and the height of each string 6 relative to neck 7. More particularly, each drum 20 has a first internally threaded hole 21 extending laterally through both sides thereof, slightly offset from the center thereof, a pair of second internally threaded holes 22 extending only through one side thereof, perpendicular to holes 21 and on opposite sides thereof, and a pair of third unthreaded holes 23 which extend only through the other side thereof, coaxial with holes 22, holes 23 having a smaller diameter than holes 22. Each drum 20 also includes a lateral groove 24 in the outer surface thereof, grooves 24 being centered relative to the ends of drums 20.

Drums 20 are connected to base member 11 of bridge 10 by means of a plurality of identical bolts 27 which extend through holes 18 in section 16 of base member 11 and through holes 21 in drums 20. The heads 28 of bolts 27 are protected beneath section 17 of base member 11. A spring 29 surrounds each bolt 27, between its associated drum 20 and section 16 of base member 11. Springs 29 urge drums 20 away from section 16 of base member 11, insuring that heads 28 of bolts 27 remain in contact with section 16. It will be evident that rotation of bolts 27 relative to drums 20 moves drums 20 laterally, towards or away from section 16 of base member 11, providing one degree of lateral movement of each of drums 20.

Bridge 10 includes a plurality of set screws 31, two for each of drums 20. A set screw 31 is positioned in each threaded hole 22 with the head of each set screw 31 within drums 20, facing holes 23 therein. The other ends of all of set screws 31 extend outwardly from drums 20 into contact with section 12 of base member 11. Thus, the axial positions of the two set screws 31 relative to their associated drum 20 determines the spacing between drums 20 and section 12 of base member 11, providing a second degree of lateral movement of each of drums 20. A conventional Allen wrench may be extended through any of holes 23 in drums 20 to engage the socket in the head of the facing set screw 31 to rotate set screws 31 relative to drums 20. For present purposes, it should also be noted that drums 20 are positioned in end-to-end relationship between heads 15 of bolts 14. As seen most clearly in FIG. 3, the combined length of drums 20 is slightly less than the spacing between heads 15 to permit freedom of movement of drums 20.

Bridge 10 further includes means for urging all of drums 20 in an axial direction, into contact with each other, and the first drum 20A into contact with head 15 of the adjacent bolt 14. More specifically, body 8 of instrument 9 has a plurality of holes 2 extending laterally therethrough, parallel to holes 3, there being one hole 2 for each of strings 6. As is well known in the solid body instrument industry, strings 6 extend through holes 2 with the beads 6A connected to the ends thereof trapped within cups 2A placed in the enlarged ends of holes 2 in the bottom of body 8. Section 12 of base member 11 has a plurality of holes 32 therein, holes 32 being aligned with holes 2 in body 8 of instrument 9 so that strings 6 may extend therethrough. From holes 32, strings 6 extend over drums 20, through the grooves 24 therein, and are then directed over neck 7 of instrument 9. It is significant to note that holes 32 extend partially beneath bolts 27. Thus, as strings 6 extend upwardly and out of holes 32, they are partially wrapped around springs 29 and bolts 27 before being conducted to grooves 24 in drums 20.

OPERATION

In operation, strings 6 are connected to instrument 9 by extending them through holes 2 and 32 in body 8 and base member 11, respectively, around springs 29 and bolts 27, and over drums 20 to neck 7. As will be evident from an inspection of FIGS. 2 and 5, rotation of set screws 31 relative to drums 20 elevates drums 20 relative to section 12 of base member 11, thereby permitting individual adjustment of the height of each string 6 relative to neck 7. Once the height adjustment is made, the individual bolts 27 may be rotated to move drums 20 in the direction of strings 6 to adjust the length thereof so that the octave points coincide with one of frets 5.

Because of the location of holes 32 in section 12 of base member 11, strings 6 are partially wrapped around springs 29 and bolts 27 before being conducted to grooves 24 in drums 20. All of strings 6 are wrapped around the same sides of bolts 27, the right hand side as viewed in FIGS. 2 and 6. This applies a force to each of bolts 27 which is directed to the left, as viewed in FIG. 6. This force urges all of drums 20 to the left, as viewed in FIG. 6 and, more particularly, urges drum 20A into contact with head 15 of the adjacent bolt 14, head 15 operating as a fixed post connected to base member 11. The remaining drums 20 are forced into contact with each other so that the entire space between heads 15 of bolts 14 is between the drum 20 at the other end of the row, drum 20B, and the head 15 of the adjacent bolt 14. By urging all of drums 20 axially into contact with each other and a fixed post, the ability for drums 20 to vibrate is substantially reduced, maximizing the tone sustaining capabilities of strings 6 of instrument 9.

Holes 23 in drums 20 are unthreaded and smaller in diameter than the outer diameter of set screws 31. Thus, upon continued retraction of set screws 31, they come into contact with the inside surface of drum 20, adjacent holes 23, and can move no further. On the other hand, holes 23 are large enough to permit a conventional Allen wrench to be inserted therethrough and into the slots in the heads of set screws 31. With this construction, it is virtually impossible for set screws 31 to become disengaged from drums 20 and become lost. Set screws 31 can only be withdrawn from the bottoms of drums 20 and once set screws 31 are inserted into holes 22 and bolts 27 extended into holes 21, bolts 27 do not permit sufficient upward movement of drums 20 to permit the removal of set screws 31.

Still further, set screws 31 cannot be extended through holes 23 to a point where they would rub across the sleeve of a player of instrument 9, preventing damage to such sleeve. Furthermore, holes 23, by being small and unthreaded, provide a smooth intersection with the outer surface of drums 20 so there is also no rough edge to rub across the sleeve of the player of instrument 9.

It can therefore be seen that according to the present invention, the problems encountered heretofore with this type of bridge have been solved. Bridge 10 includes a plurality of independently movable drums 20 which permit separate adjustment of the height of each string 6 relative to neck 7 of instrument 9 and simultaneous adjustment of the length of each string 6 thereby permitting the greatest latitude of adjustment possible for each string 6. However, bridge 10 substantially reduces the tendency for drums 20 to vibrate, substantially increasing the tone sustaining capabilities of strings 6 over that obtainable heretofore. Furthermore, drums 20 are constructed and connected to base member 11 in a manner which prevents loss of set screws 31 and which prevents damage to the sleeve of player of an instrument using bridge 10.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. A bridge for a stringed instrument including a body and a neck comprising:
   - a base member rigidly connectable to said body of said instrument;
   - a plurality of drums;
   - means connecting said drums to said base member in end-to-end relationship for independent lateral movement in two orthogonal directions to separately adjust the length of each string and the height of each string relative to said neck;
   - a fixed post connected to said base member, adjacent one end of the first one of said drums; and
   - means operatively positioned adjacent said drums for conducting said strings into engagement with said drums connecting means and said drums so as to apply an axial force to each of said drums and to urge all of said drums axially into contact with each other and said first drum into contact with said post.

2. A bridge for a stringed instrument according to claim 1 wherein said base member has a first planar section connectable to said body of said instrument and a second planar section connected to one end of said first section and extending perpendicular thereto, wherein each of said drums has an internally threaded hole extending laterally therethrough, wherein said means connecting said drums to said base member comprises a plurality of bolts extending through said second section of said base member and through said holes in said drums whereby rotation of said bolts relative to said drums moves said drums towards or away from said second section of said base member, and wherein said means for conducting said strings comprises:

a plurality of holes in said first section of said base member, one for each of said drums, each of said holes extending at least partially beneath its associated one of said bolts, said strings extending through said holes in said base member, around said bolts, and over said drums.

3. A bridge for a stringed instrument according to claim 1 wherein said means for conducting said strings at least partially wraps each of said strings around its associated drums connecting means to apply a force to each of said drums connecting means towards said post.

4. A bridge for a stringed instrument according to claim 1 wherein said base member has a first planar section connectable to said body of said instrument and a second planar section connected to one end of said first section and extending perpendicular thereto, wherein each of said drums has a first internally threaded hole extending laterally therethrough, a pair of second internally threaded holes extending partially, laterally therethrough, perpendicular to said first holes, and a pair of third unthreaded holes extending partially, laterally therethrough, coaxial with said second holes, said third holes having a smaller diameter than said second holes, and wherein said means connecting said drums to said base member comprises:

a plurality of bolts extending through said second section of said base member and through said first holes in said drums whereby rotation of said bolts relative to said drums moves said drums towards or away from said second section of said base member; and a plurality of set screws positioned in said second holes in said drums, all of said set screws extending outwardly from said drums and into contact with said first section of said base member to adjust the height of said drums relative to said base member, said third holes being adapted to receive a wrench for contacting said set screws in said aligned second holes to rotate same relative to said drums.

5. A bridge for a stringed instrument according to claim 4, wherein said means for conducting said strings comprises:

a plurality of holes in said first section of said base member, one for each of said drums, each of said holes extending at least partially beneath its associated one of said bolts, said strings extending through said holes in said base member, around said bolts, and over said drums.

6. A bridge for a stringed instrument including a body and a neck comprising:

a base member having a first planar section connectable to said body of said instrument and a second planar section connected to one end of said first section and extending perpendicular thereto;

a plurality of drums, the strings of said instrument engaging said drums, each of said drums having a first internally threaded hole extending laterally therethrough, a pair of second internally threaded holes extending partially, laterally therethrough, perpendicular to said first holes, and a pair of third unthreaded holes extending partially, laterally therethrough, coaxial with said second holes, said third holes having a smaller diameter than said second holes;

a plurality of bolts extending through said second section of said base member and through said first holes in said drums whereby rotation of said bolts relative to said drums moves said drums towards or away from said second of said base member to separately adjust the length of each string; and a plurality of set screws positioned in said second holes in said drums, all of said set screws extending outwardly from said drums and into contact with said first section of said base member to permit adjustment of the height of said drums relative to said base member, said third holes being adapted to receive a wrench for contacting said set screws in said second holes to rotate same relative to said drums.

* * * * *